United States Patent [19]

Jensen

[11] 4,287,688

[45] Sep. 8, 1981

[54] APPARATUS FOR GRINDING PLANE, ANNULAR SURFACES, ESPECIALLY ON FAYING RINGS IN GATE VALVES

[75] Inventor: Per Jensen, Moss, Norway

[73] Assignee: Rino Solberg, Norway

[21] Appl. No.: 743,741

[22] Filed: Nov. 22, 1976

[30] Foreign Application Priority Data

Nov. 21, 1975 [NO] Norway ..... 753913

[51] Int. Cl.[3] ..... B24B 15/02

[52] U.S. Cl. ..... 51/241 VS

[58] Field of Search ..... 51/241 VS, 241 A, 241 B, 51/245, 120

[56] References Cited

U.S. PATENT DOCUMENTS

| | | | |
|---|---|---|---|
| 771,194 | 9/1904 | Williams | 51/241 VS |
| 2,572,485 | 10/1951 | Hunter et al. | 51/241 A |
| 2,674,069 | 4/1954 | Bauer | 51/241 B |
| 2,720,736 | 10/1955 | McAfee | 51/241 VS |
| 2,865,142 | 12/1958 | Dunipace et al. | 51/120 |
| 3,648,416 | 3/1972 | Rogers | 51/241 VS |

FOREIGN PATENT DOCUMENTS

| | | | |
|---|---|---|---|
| 2400077 | 7/1975 | Fed. Rep. of Germany | 51/241 A |

*Primary Examiner*—Roscoe V. Parker

*Attorney, Agent, or Firm*—William A. Drucker

[57] ABSTRACT

In an apparatus for grinding plane, annular surfaces such as for lapping faying rings of gate valves, cylindrical grinding heads carrying grinding paper detachably adhering thereto, are mounted for free individual rotation in a rotating disk, so that by friction on the annular surface they rotate like planet wheels. The disk is detachably mounted on a spherical head on a shaft and connected thereto by a rockable diametrical entraining pin, and the shaft is connected to a driving shaft by sprocket wheels and chain.

4 Claims, 3 Drawing Figures

APPARATUS FOR GRINDING PLANE, ANNULAR SURFACES, ESPECIALLY ON FAYING RINGS IN GATE VALVES

BACKGROUND OF THE INVENTION

The invention relates to the grinding of plane, annular surfaces. In particular, it is intended for the grinding of faying rings in gate valves, i.e. valves to be inserted in pipelines, in which two opposed inclined valve seats are equipped with metallic faying rings cooperating with corresponding rings on a wedge-shaped valve gate carried by a rod axially guided in the cover of an upwardly extending socket on the valve housing. In order to afford satisfactory sealing against operation pressures, the cooperating plane faces of the faying rings must be lapped at intervals, and since this is a heavy and time-consuming work, various types of grinding apparatus have been developed for the purpose. A difficulty in that connection is that the rings in the fixed valve housing are poorly accessible and the grinding apparatus must be operated and driven from outside the valve housing, and that the angle between the faying planes may vary from one manufacture to the other, even though there exist certain standard measures for the dimensions of the opening.

The apparatus mostly used for the purpose has been described in U.S. Pat. No. 2,720,736 and is equipped with a grinding disk which through bevel gears is driven for rotation by a shaft supported in a sleeve adjustably mounted in a fixed frame and is carried by a spherical head so as to be capable of adapting itself to varying angles of the faying surfaces and also to oblique positions of the supporting shaft of the disk relative to these.

Besides being complicated and expensive like other apparatus based on the same principle and described for example in Norwegian Patent specification No. 84 764 and French Patent specification No. 1 181 397, the apparatus disclosed in the said U.S. specification suffers from the serious drawback that the rotating grinding disks cut grooves in the faying faces and their own grinding faces are rapidly worn locally by these.

For remedying this drawbrack, some proposals have been published which, however, suffer from other important disadvantages and have had no success in practice.

Thus, the published German Patent application No. 2 400 077 shows a structure in which an arm rotating in a plane parallel to the annular surface carries a grinding head supported for rotation in the arm and driven by a turbine which is mounted in the arm and has an air supply thereto through a hose or centrally from the axis of rotation, or by a separate driving belt. Here the work is time-consuming, the design is complicated, especially as regards power supply, and above all it requires a extremely exact adaptation of the position of the arm relative to the annular surface, since there does not exist any self-adjusting effect like in the prior apparatus mentioned above.

Further, the U.S. Pat. No. 2,942,388 discloses various embodiments of grinding apparatus for the purpose, in which a grinding disk in addition to a rotational movement also performs a superposed reciprocating movement along the annular face. Here a self-adaptation is possible, but in return the design is extremely complicated and delicate.

SUMMARY OF THE INVENTION

In an apparatus according to the invention, the desired effect is achieved in a much simpler, cheaper and more reliable and efficient manner. Even in this apparatus, the grinding material in addition to taking part in a rotational movement of a rotatable carrying disk is capable of performing superposed transverse movements. However, in this case this is achieved due to the fact that the grinding material is distributed on grinding heads supported for free rotation in the disk about individual axes distributed on a pitch circle around its centre, so that by frictionally engaging an annular surface having its centre substantially in the centre of the pitch circle and having a mean radius different from the radius of the circle, they will rotate like planet wheels when the disk rotates.

Thereby it is possible to achieve an efficient grinding action with grinding surfaces rotating quickly because of the transmission ratio of the grinding disk and the grinding faces, and that without separate drive of the grinding heads and at several places of the annular surface at the same time, which not only contributes to a rapid wearing action, but also easily permits self-adaptation to possible oblique positions, so that locating of the disks is not critical. The dimensions of the pitch circle and the grinding faces are conveniently so adapted relative to existing standard dimensions of the annular faces that the grinding faces, while bridging the width of the annular face, will have the centre outside thesame, preferably on the inner side, so as to cause the planet drive effect to be as efficient as possible, and besides, the grinding faces are preferably made annular so as to avoid undesirably low linear velocities adjacent their centres.

To make the picture of the novelty situation complete it may be mentioned that it is not generally novel to make use of the frictional engagement between a rotatable grinding body and a piece to be ground, for causing rotation of the grinding body. To be more specific, the U.S. Pat. No. 3,648,416 discloses an apparatus in which a valve member is attached and driven in rotation and a convex conical face of the same engages the front face of a grinding disk supported for free rotation. Hence, there is no question of a planet drive, and practically only line contact and rolling friction are obtained, so that no substantially grinding action will occur unless a braking force is applied to the grinding disk.

For avoiding the necessity of replacing the grinding heads when the grinding faces have been worn out, these are conveniently formed on grinding paper or cloth detachably adhering to the grinding heads, for example with bilaterally adhesive tape. Since different kinds of grinding paper are best suited for different materials in the annular faces, such as gun metal, cast steel or acid resistant and stainless material, it will also be possible in that connection to use a same apparatus with optimum operational function for such different materials simply by changing the grinding paper.

Further features of the invention, especially with respect to mounting, driving and adaptation to different ring dimensions, will appear from the following description of a preferred embodiment which is illustrated in the accompaning drawings.

DETAILED DESCRIPTION OF THE PREFERRED EMBODIMENT

Figure 1:
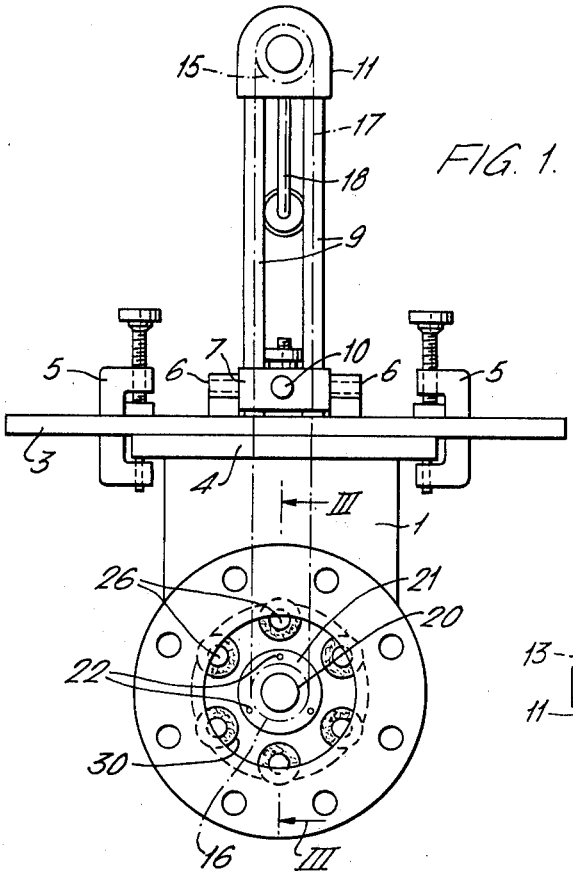
FIG. 1 is a front elevation of a gate valve housing with the inserts removed and the apparatus according to the invention attached to it.

In the embodiment shown the apparatus is intended for grinding the plane faying faces of the cooperating rings of a gate valve. 1 designates the valve housing and 2 the seat rings in it. The apparatus comprises a mounting frame in the form of a plate 3 which is clamped onto the top flange 4 of the valve housing with clamps 5. A clamping block 7 is supported in bearings 6 on the plate 3 for pivotal motion in the symmetry plane of the valve housing and is fixed relative to the plate 3 with nuts on a bolt 8. A pair of tubes 9 are fixed in the block 7 and capable of being displaced longitudinally therein upon loosening of a tightening screw 10. The tubes 9 extend in mounted position down into the valve housing 1 and are at the top and the bottom attached in bearing casings 11 and 12, respectively, for the shafts 13 and 14 of sprocket wheels 15 and 16, respectively, which are interconnected by a driving chain passing through the tubes, as indicated in dash and dot lines at 17. The upper shaft 13 is connected to a driving member 18 which has been indicated diagrammatically as a handle crank, but may conveniently be constituted by a motor, for example driven by compressed air.

The driven shaft 14 is supported axially and radially by self-lubricating bronze bearings 19 in the casing 12 and is outside the same formed with a head 20 having a spherical circumferential surface. Supported on this bearing surface is a hub 21 composed of two parts held together by screws 22, so as to permit dismantling. Due to the spherical support on the head 20, the hub 21 is capable on turning in the pivotal plane of the clamping block 7 by an angle limited by the abutting of an entraining pin 23 in a diametric opening 24 in the spheric head 20, the opening 24 expanding to opposite sides from the centre of the sphere.

Figure 2:
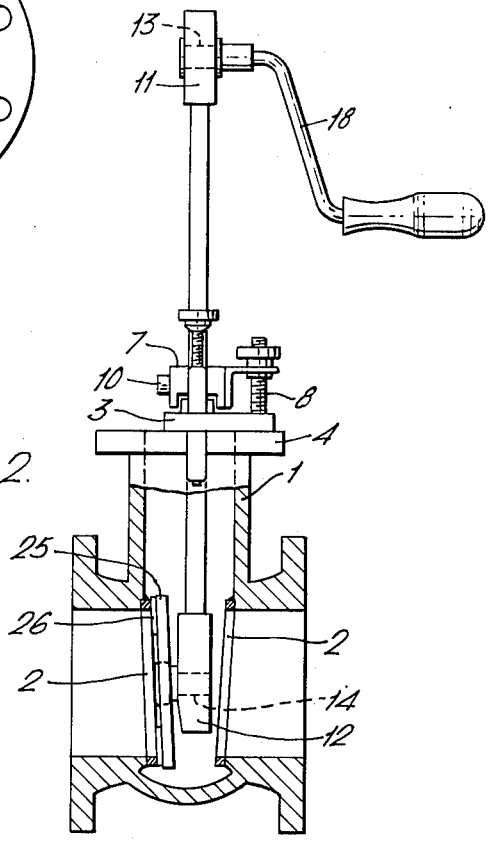
FIG. 2 shows the same in side view with the valve housing in longitudinal section.
Figure 3:
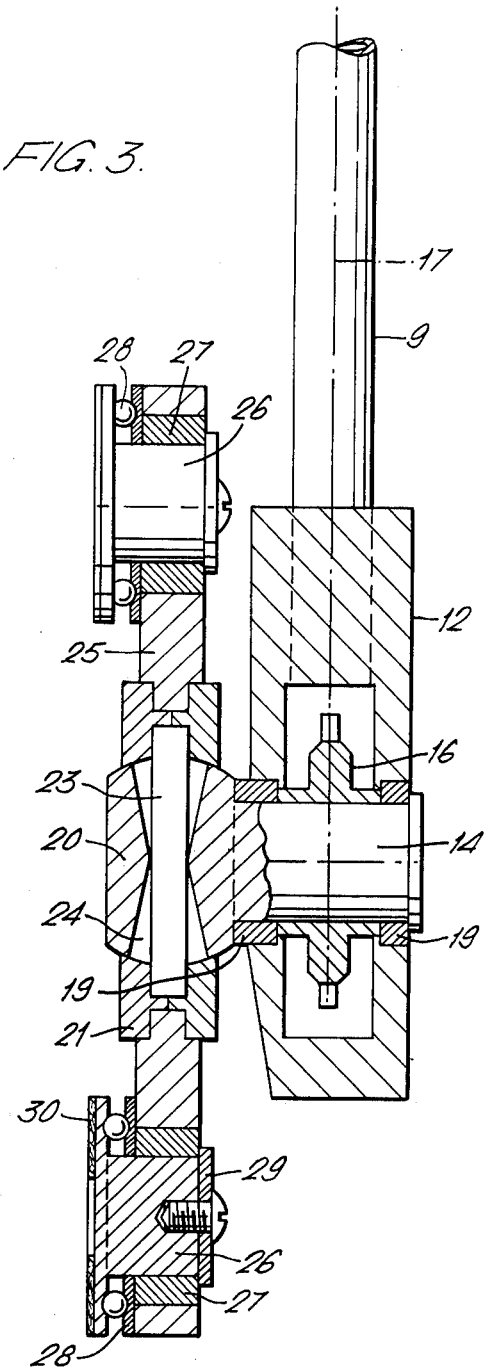
FIG. 3 shows a cross-section of the apparatus along the line III—III in FIG. 1 on a larger scale.

On the outer circumference of the hub 21 there is fixed a supporting disk 25 carrying grinding heads 26 evenly spaced on a pitch circle concentric to the head 20. The grinding heads are cylindrical and are mounted for rotation in the disk 25 by radial bearings 27, preferably plane bearings of self-lubricating bronze, and axial bearings 28, preferably needle or ball bearings, and are axially fixed by backing disks 29 screwed to their rear faces as best shown in sectional view at the bottom of FIG. 3. On its plane front side each grinding head 26 carries an annular grinding surface 30 of detachably adhering grinding paper elected dependent on the material in the rings 2. As indicated in FIGS. 1 and 2, the radius of the pitch circle of the axes of the grinding heads is chosen so that with the standard dimensions of the rings 2 for which the apparatus is intended, they extend somewhat inside the inner edge of the face of the ring, and the diameter of the grinding surfaces of the heads is sufficient for making these extend past the outer edge of the ring face in use when the grinding faces engage the faying ring and the centre of the spherical head 20 is placed in the axis of the faying surface.

In use for grinding the ring faces in a valve housing as shown, the apparatus is mounted on the flange 4 with its mounting plate 3 in a position such that the pivotal axis of the clamping block 7 is parallel to the plane of the annular face of the ring 2 concerned and the axis of the shaft 14 extends in a vertical plane through a diameter of the annular surface. Then the shaft 14 is brought to correct level by displacing the tubes 9, which are then fixed in the block 7 and moved towards the ring 2 until the grinding faces 30 engage the same with a suitable pressure, whereafter this position is fixed by means of the nuts on the screw bolt 8. However, it will be appreciated that none of these adjustments is particularly critical. Now, rotation is started with the driving member 18, whereby the shaft 14 with the spherical head 20 through the pin 23 will rotate the disk 25 with the grinding heads 26. Because of the frictional engagement with the annular ring face, the grinding heads will thereby in addition to their circular motion be caused to peform a rotative motion relative to the disk 25, whereby the plane annular face of the ring will be efficiently ground without any risk of grooving. It will easily be appreciated that during the preliminary adjustment the grinding faces will adjust themselves to the plane of the ring surface, since due to the spherical support of the supporting disk 25 on the ball 20, the disk is capable both of being turned in the axial plane through the pin 23 and of turning about the latter.

Readjustment according as the annular face is milled down, is easily possible by adjustment on the bolt 8.

The same apparatus which is used for the stationary seat rings 2 of the valve is also used for the corresponding faying rings on the appurtenant wedge-shaped valve gate. This is easily possible by fixing the plate 3 and the valve gate on a common supporting frame.

If there is a demand for grinding annular surfaces of different sizes, it will be possible to replace the disk 25 upon dismantling of the hub 21 by removing the screws 22. It will then be possible to use the same grinding heads 26, since these can easily be dismantled together with the bearings 28 by removing the fixing screws of the backing disks 29, and inserted in a supporting disk 25 of different size.

What I claim is:

1. Apparatus, for grinding plane annular surfaces, comprising:

(i) a support (ii) means for mounting the support opposite to the annular surface with the support being rotatable about an axis which is substantially in alignment with the axis of the annular surface, (iii) a plurality of grinding heads carried in freely rotatable manner by said support, said grinding head being rotatable about a respective axis of rotation which is parallel to the axis of rotation of the support, the respective axes pf rotation of the grinding heads being all disposed on a pitch circle concentric with the axis of rotation of the support, the radius of the pitch circle being different from the main radius of the annular surface whereby each grinding head as a result of grinding engagement with the annular surface performs a planatary rotation as the support is rotated, wherein the means for mounting the support comprises:

(a) a multi-part hub having an integral part-spherical bearing surface, said support being mounted on said hub with the axis of rotation of the support coincident with the center of said bearing surface, (b) a driving shaft having a part-spherical head on which said multi-part hub is engaged by its part-spherical bearing surface, said part-spherical head having in it a diametral opening which increases in cross-section from the center of the head to the periphery of the head, and (c) an entraining member disposed in said diametral opening and extending radially therefrom at each end to engage into said multi-part hub, whereby the axis of rotation of said multi-part hub may vary, with respect to the axis of rotation of said part-spherical head to the extent permitted by movement of the entraining member within said diametral opening.

2. Apparatus, as claimed in claim 1, wherein each grinding head includes a detachably adherent grinding cloth or paper.

3. Apparatus, as claimed in claim 1, wherein each grinding head has an annular grinding face.

4. Apparatus, as claimed in claim 1, wherein the means for mounting the support further comprise:

(A) a housing composed of a pair of substantially parallel tubes, (B) a first bearing casing, for said driving shaft, carried on one end of said housing, (C) a second bearing casing, for a second shaft, carried on the other end of said housing, (D) first and second sprockets secured respectively on said driving shaft and on said second shaft (E) a chain engaged about said sprockets and passing through said tubes, (F) a driving member connected to said second shaft (G) a mounting frame (H) a clamping member mounted on said mounting frame for pivoting movement about an axis normal to the axis of rotation of said driving shaft, said housing being longitudinally slidable in said clamping member, (I) means for securing said housing in a selected position of longitudinal sliding in said clamping member, (J) means for securing said clamping member in a selected position of pivoting movement relative to said mounting frame.

* * * * *